US007314420B2

(12) United States Patent
Konstant

(10) Patent No.: US 7,314,420 B2
(45) Date of Patent: Jan. 1, 2008

(54) BAG TOSSING GAME

(76) Inventor: James J. Konstant, 9112 S. Richmond St., Evergreen Park, IL (US) 60805

( * ) Notice: Subject to any disclaimer, the term of this patent is extended or adjusted under 35 U.S.C. 154(b) by 15 days.

(21) Appl. No.: 11/153,735

(22) Filed: Jun. 15, 2005

(65) Prior Publication Data

US 2006/0038341 A1 Feb. 23, 2006

(51) Int. Cl.
*A63B 43/04* (2006.01)
*A63B 63/00* (2006.01)

(52) U.S. Cl. ..... 473/594; 273/317

(58) Field of Classification Search ..... 473/594; 273/398–402, 317

See application file for complete search history.

(56) References Cited

U.S. PATENT DOCUMENTS

| | | | | |
|---|---|---|---|---|
| 922,717 | A | 5/1909 | Parker | |
| 3,517,933 | A * | 6/1970 | Malkin | 473/125 |
| 3,554,550 | A | 1/1971 | Schram | |
| 3,734,498 | A * | 5/1973 | Seiersen | 473/125 |
| 3,749,402 | A | 7/1973 | Adickes et al. | |
| 3,788,643 | A | 1/1974 | Morrison et al. | |
| 3,975,014 | A | 8/1976 | Ryan et al. | |
| 4,087,091 | A | 5/1978 | DeLorge | |
| 4,186,925 | A | 2/1980 | Goldfarb et al. | |
| 4,486,023 | A | 12/1984 | Tomoff | |
| 4,805,918 | A | 2/1989 | Feinberg | |
| 4,927,160 | A | 5/1990 | Nichol et al. | |
| 4,938,485 | A | 7/1990 | Hockridge et al. | |
| 4,943,065 | A | 7/1990 | DeLapa | |
| 5,181,726 | A | 1/1993 | Piaget | |
| 5,492,320 | A | 2/1996 | Hoffman et al. | |
| 5,772,543 | A * | 6/1998 | Paino | 473/594 |
| 5,871,216 | A | 2/1999 | Sparacino | |
| 6,866,268 | B2 | 3/2005 | Christianson | |
| 2003/0184013 | A1 * | 10/2003 | Chodosh | 273/139 |

OTHER PUBLICATIONS

Gopher Sport Web catalog page, 2002.*
Declaration of Mark S. Graham with Exhibit A, Feb. 15, 2007.*
BeanBag Bocce, website catalog, www.gophersport.com, 1 page.
Home Gopher, website catalog, www.gophersport.com, dated Nov. 23, 2004, total of 7 pages.

* cited by examiner

*Primary Examiner*—Mark S. Graham
(74) *Attorney, Agent, or Firm*—Cook, Alex, McFarron, Manzo, Cummings & Mehler, Ltd.

(57) ABSTRACT

A bag throwing game for a plurality of players. One embodiment of the game includes a target bag having a pair of opposite sides. An indicia applied to one side of the target bag and covering a portion but not the entire side thereof. Throwing bags are provided for each player or team. Each player's throwing bags having sides of a different color than the throwing bags of the other player. The throwing bags are sufficiently large to cover the indicia of the target bag. A second embodiment of the invention includes a target bag having sides of opposite, distinctive colors with different and distinctive colored indicia on each side, totaling four distinctive colors. The throwing bags for each team have opposite sides of different, distinct colors, The first team's throwing bags each having one side of a first color and a second side of a fourth color.

1 Claim, 2 Drawing Sheets

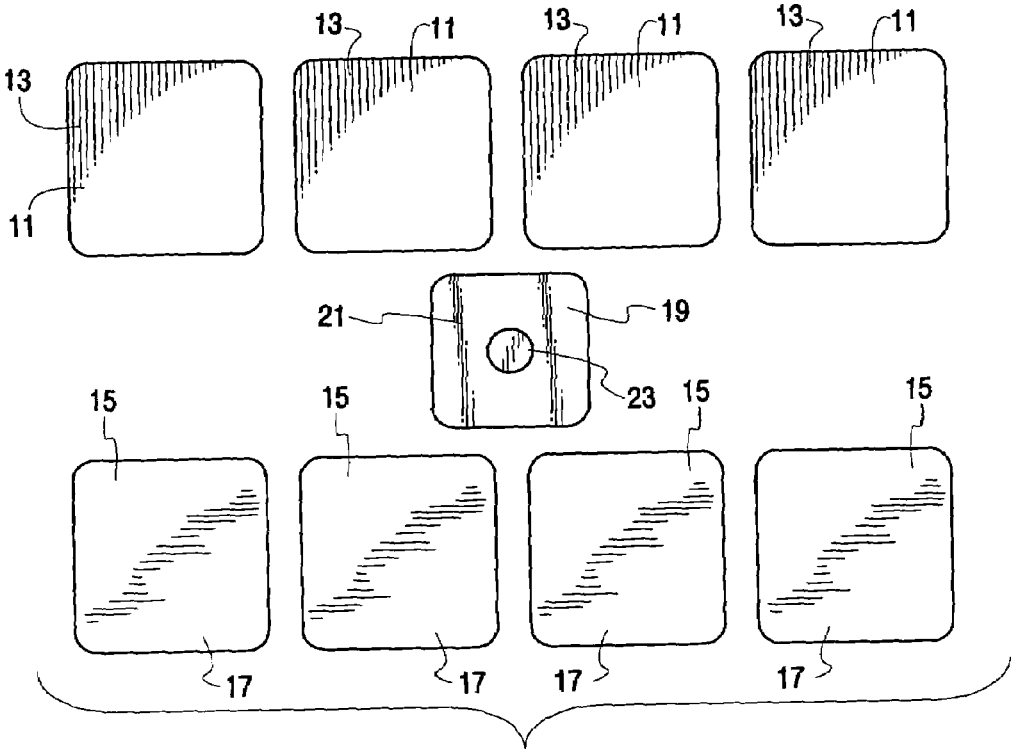
Fig. 1
Fig. 2
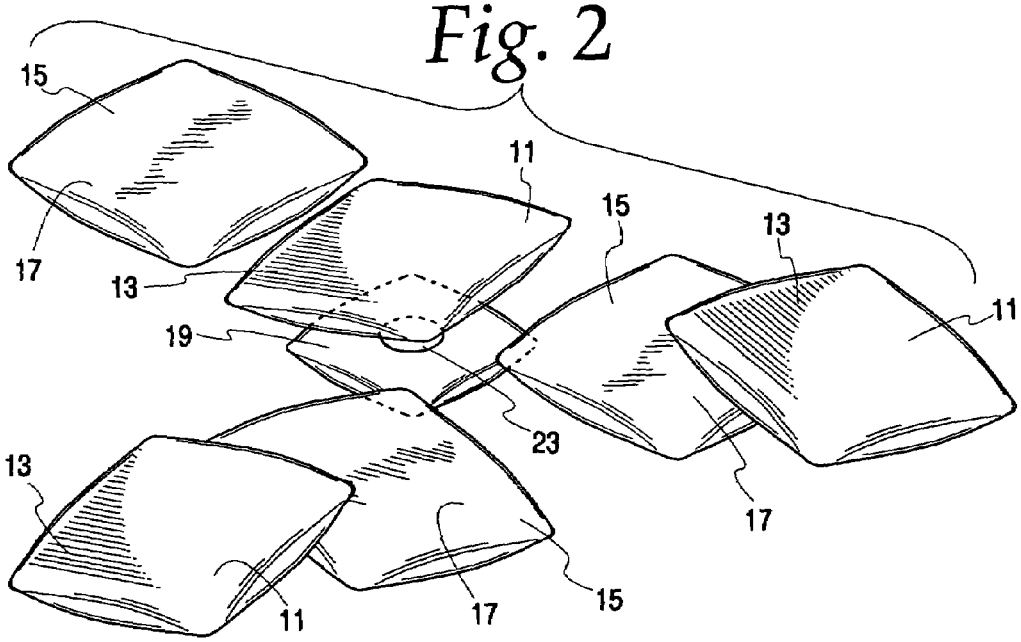

BAG TOSSING GAME

BACKGROUND OF THE INVENTION

Various types of competitive throw or toss games have been played over the years. One well known example of such a game is horseshoes. Initially, the thrown object was an actual horseshoe and the target was a metal post. Later refinements included the substitution of lightweight plastic imitation horseshoes for the heavy metal shoes. Another ancient game is bocce ball in which a first player throws a smaller target ball and the other players roll or throw their larger balls to land close to the target ball. This game has been conventionally been played outdoors on walkways or paths because of the use of large balls which could damage indoor surfaces. Other variations of throw and toss games include what are sometimes called bean bag games. The thrown object was usually a bag of cloth or other flexible material filled with metal shot or heavy granular material such as sand. In many previous games, the bags were thrown at targets. Such targets have varied from simple markings on the ground to indicate target portions of different values to container-like targets having openings or pockets into which the bean bag was thrown. More recent modifications to such games have included mechanical and electronic apparatus for automatically scoring the outcomes of the games.

This invention is directed to an improved bean bag game that can be played indoors or outdoors with a minimum amount of game equipment yet provides all the desirable features of previous games such as horseshoes, bocce ball or bean bag toss games without any of the disadvantages or limitations of such games.

SUMMARY OF THE INVENTION

This invention is directed to a competitive bean bag throw game for play by teams of one, two or four members each. The equipment used to play the game is inexpensive to make because only simple bags are used and no expensive targets are required. Because the thrown bags are small and relatively light weight, the game can be played indoors without causing damage to floors or walls. Also, like the game of bocce ball, it is not necessary to apply markings that could deface floors or walls.

BRIEF DESCRIPTION OF THE DRAWINGS

FIG. 1 is a plan view of the throwing and target bags of a first embodiment of the invention;

FIG. 2 is a perspective view of some of the throwing bags of FIG. 1 in play with one of the throwing bags overlying a portion of the target bag;

FIGS. 5*a* and 5*b* are perspective views of the opposite sides of the throwing bags of a second team for use in a second embodiment of the invention.

Figure 3A:
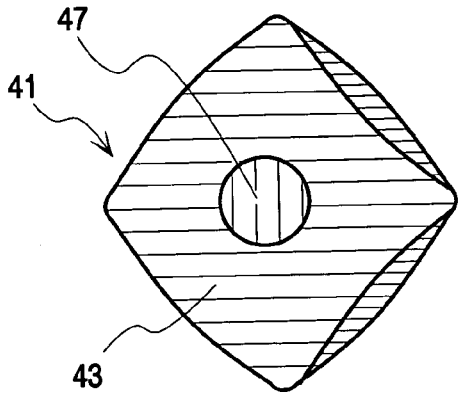
FIGS. 3*a* and 3*b* are perspective views of the opposite sides of a target bag of a second embodiment of the invention.

The equipment needed to play the game in its simplest form or embodiment includes eight bean bags, which are the thrown or scoring bags, four of which are of one color and the other four of which are of another contrasting and distinctive color. One additional bean bag, which is the target, is slightly smaller than the scoring bags. The target bag has an indicia on one side thereof, which is shown as a circle in the drawings but may also be a square or a similar geometric figure. The target bag may be made of a color different than the two colors of the thrown or scoring bags and the indicia on the target bag should contrast with the color of the target bag for ease of visibility. The dimensions of the indicia relative to the dimensions of the target bag may vary but a suitable indicia has been found to be a circle one inch in diameter for a rectilinear target bag having planar dimensions of approximately four inches by four inches.

FIG. 1 of the drawings shows the equipment needed to play the first embodiment of the bag game of this invention. The equipment includes two sets of thrown or scoring bags. One set of four (4) scoring bags 11 are of one color 13 and the other set of scoring bags 15 are made of a second and contrasting color 17. The planar dimensions for a suitable rectilinear scoring bag is approximately five and one-half inches by five and one-half inches. A target bag 19 is also included as a component of the game equipment. The target bag is smaller than the scoring bags in rectilinear dimensions and is made in a color 21 which contrasts with the colors 13 and 17 of the throwing bags. An indicia or icon such as a circle 23 is centrally affixed to one side of the target bag 19. The circle is made of a third color 25 which contrasts with the colors 13 and 17 of the scoring bags 11 and 15, respectively.

The tossing game of this embodiment of the invention is played in the following manner:

A member of the first team throws the target bag 19 any distance and in any direction he or she chooses. If the target bag 19 lands with its indicia 23 facing up as it is depicted in FIG. 2 of the drawings, the second team will attempt to throw one of its bags 15 so that it lands on and covers the indicia circle 23 on the target bag. Teams alternate in throwing their scoring bags until all of the bags are thrown. Only a portion of the scoring bags are shown in FIG. 2 of the drawings for clarity of illustration.

The game of the first embodiment of the invention is scored in the following manner:

If the target bag 19 lands with its indicia circle 23 facing upwardly and a scoring bag 11 or 15 lands on the target bag and completely covers the indicia circle 23 the team throwing the scoring bag receives three points. Two points are awarded if a scoring bag touches but doesn't entirely cover the indicia circle 23 on the target bag 19. One point is awarded for each scoring bag closer to the target bag than any other scoring bag of the other team.

If the target bag 19 lands with the indicia circle 23 facing down, then one point is awarded for each scoring bag closer to the target bag than any other scoring bag of the opponent. Only one team can score on each round.

If a team's scoring bag lands on an opponent's scoring bag lying on the target bag 19 and covering the indicia circle 23 of the target bag, the scoring bag on top is awarded six points and the scoring bag of the opponent covering the indicia circle loses its three points. For a scoring bag to be considered as on top of a lower scoring bag of an opponent in such situation, at least 50% of the lower scoring bag must be covered by the upper scoring bag.

The first team to reach 24 points in one version of the game is considered the winner. The game can be shortened or lengthened by varying the number of points required to win.

The manner of scoring the game, the number of teams and the number of players on each team may be varied in accordance with the situation.

FIGS. 3*a* to 5*b* of the drawings show the equipment needed to play a second embodiment of the bag game of this invention. The bean bags which are the thrown or scoring bags are of the same construction and sizes as described for the similar bags of the first embodiment of this invention. As in the first embodiment of the invention, the bean bag which is the target bag is slightly smaller than the scoring bags.

Figure 3B:
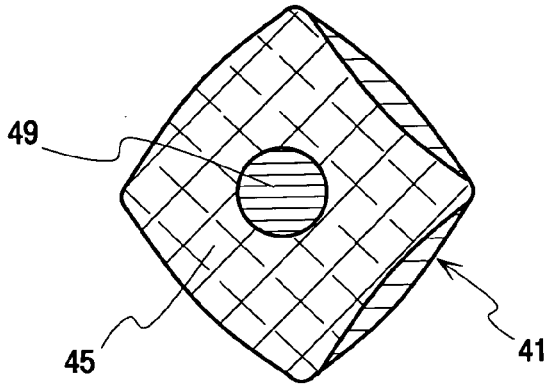
Figure 4A:
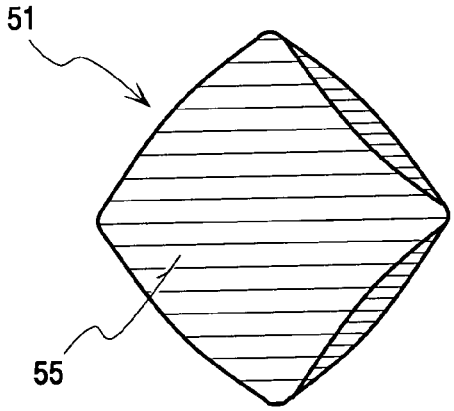
FIGS. 4*a* and 5*b* are perspective views of the opposite sides of the throwing bags of a first team for use in a second embodiment of the invention.
Figure 4B:
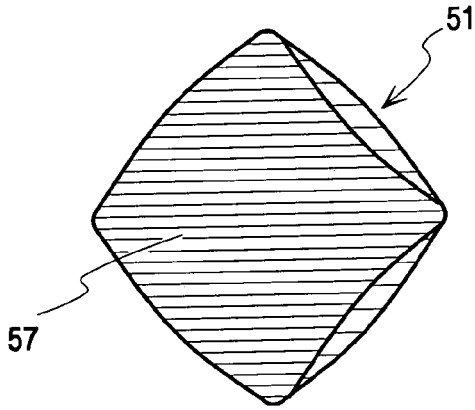
Figure 5A:
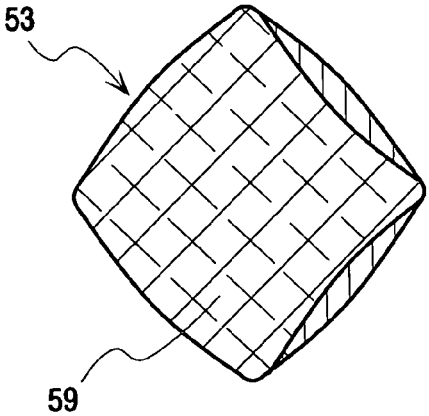
Figure 5B:
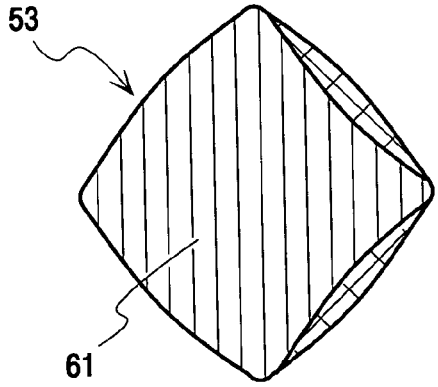

FIGS. 3*a* and 3*b* of the drawings shows a target bag 41 used in playing the second embodiment of the bag game. The planar dimensions of a suitable target bag are approximately four inches by four inches which are slightly smaller in rectilinear dimensions than are the dimensions of the thrown or scoring bags of the first embodiment of the invention. As is conventional for a bean bag, the target bag 41 has opposite facing sides 43 (FIG. 3*a*) and 45 (FIG. 3*b*). Side 43 is one color, in this example royal blue, and the opposite side 45 is orange. Indicia 47 and 49 are provided on the opposite sides 43 and 45. Because the side 43 in this example is royal blue, the indicia 47 applied to it is of a contrasting color, in this example red. Indicia 49 applied to side 45 is navy blue in order to contrast with the orange color of side 45.

Indicia 47 (FIG. 3*a*) and 49 (FIG. 3*b*) are each circular, approximately one and three-quarter inches in diameter and affixed to their respective sides of the target bag 41 generally positioned in the centers thereof.

Two types of throwing or scoring bags 51 (FIGS. 4*a* and 4*b*) and 53 (FIGS. 5*a* and 5*b*) are used to play the second embodiment of the bag game of this invention. These throwing or scoring bags are bean bags of the same size and shape as the similar bags described in connection with the description of the first embodiment of this invention. However, the throwing bags of this embodiment differ from the previously described throwing or scoring bags in that each side of each bag is of a different color. For example, side 55 of bag 51 (FIG. 4*a*) is royal blue while its opposite side 57 (FIG. 4*b*) is navy blue. Side 59 of bean bag 53 (FIG. 5*a*) is orange while its opposite side 61 is red. Thus, it becomes apparent that the colors of the throwing or scoring bags 51 and 53 are coordinated with the colors of the sides 43 and 45 and indicia 47 and 49 of the target bag 41 to provide a novel method of scoring a bean bag game.

The tossing game of the second embodiment of the invention is played in the following manner:

This embodiment of the game is intended to be played by two teams. The number of players on each team can vary from one to four or more. The size of a team is usually limited to no more than four so that each player will be provided with at least one throwing or scoring bag. One team will use throwing bags 51 while the other team will use throwing bags 53.

A player of the first team throws the target bag 41 for any distance and in any direction that the player chooses subject, of course, to the geography of the playing area. The thrown target bag will land with either its side 43 or its side 45 facing upwardly. If side 43 is facing upwardly it will show a royal blue color with a red colored indicia 47. A player of the second team will throw one of his team's throwing or scoring bags such as bags 51 or 53 trying to land it on top of the target bag 41 so as to cover the indicia 47 on the target bag. The player must land the throwing or scoring bag so that its upwardly located side is the same color as either the upwardly facing side or the upwardly facing indicia of the target bag. Each of the throwing bags of each team has sides of two different colors so one of the colors will match either the color of a side of the target bag or the color of the indicia on that side of the target bag. Teams alternate in throwing their scoring bags until all eight of the bags 51 and 53 are thrown.

The game of the second embodiment of the invention is scored in the following manner:

Scores are awarded only when a thrown bag lands with an upwardly facing side having the same color as that of the upwardly facing side or indicia of the target. Three points are received by a team if one of its throwing or scoring bags covers the indicia on the target bag 41 and the color on the upper surface of the throwing bag matches the color of either the upwardly facing side or upwardly facing indicia of the target bag. Two points are awarded to a team whose throwing bag touching but does not completely cover the indicia on the target bag. One point is given for each throwing bag of a team closer to the target bag than any throwing bag of an opponent. Only one team can score in each round.

If a team's throwing bag lands on an opponent's throwing bag already covering the indicia on the upwardly facing side of the target bag, the throwing bag on top is awarded six points and the team to whom the covered throwing bag belongs loses its previously awarded points. To be considered to be on top of an opponent's throwing bag, at least 50% of the lower bag must be covered by the upper bag. In this embodiment of the invention, the first team to earn 15 points is the winner.

Whereas, the preferred embodiments of the invention have been depicted and described, it should be understood and appreciated that the invention may be manufactured and practiced in other embodiments. For example, instead of using distinctive colors to distinguish the sides and indicia of the target and throwing bags, the distinguishing features of these elements may be numbers, letters or symbols, combinations thereof or design patterns as long as the selected numbers, letters or symbols, combinations thereof or design patterns used are applied to the sides and indicia of the target bag and to the sides of one teams' throwing bags in the manner previously described for the distinctive color.

Another teaching of my invention is that the numbers, letters, symbols, combinations thereof or design patterns applied to one side of the target bag and its indicia and the numbers, letters, symbols, combinations thereof or design patterns applied to the opposite side of the target bag and its indicia are also applied to the opposite sides of the teams' throwing bags. Therefore, in interpreting or applying the claims of this invention, it should be understood and appreciated that the word color as used therein also includes numbers, letter, symbols, combinations or design patterns as appropriate.

The invention claimed is:

1. A bag throwing game for a plurality of teams of players, said game including:

a target bag having at least a pair of opposite sides, said pair of opposite sides including a first opposite side and a second opposite side, said first opposite side having a first color and said second opposite side having a second color with said first and second colors being distinctive of each other, said first opposite side of said target bag having a first indicia thereon and said second opposite side of said target bag having a second indicia thereon, said first indicia having a third color and said second indicia having a fourth color, said third and fourth colors being distinctive from each other and from said first and second colors, a plurality of throwing bags for each team of players, each of said throwing bags for each of said team of players having a pair of opposite sides, said throwing bags for a first of said team each having one opposite side of said pair of opposite sides of said first color and another opposite side of said pair of opposite sides of said fourth color, said throwing bags for a second of said team each having one opposite side of said pair of opposite sides of said second color and another side of said pair of said opposite sides of said third color, each of said throwing bags sized to obscure at least a portion of said first or second indicia of said target bag when overlying said target bag.

* * * * *